US012319483B2

(12) United States Patent
St. Lawrence

(10) Patent No.: US 12,319,483 B2
(45) Date of Patent: Jun. 3, 2025

(54) ORAL AND/OR BUCCAL DELIVERY POUCH AND METHOD OF MAKING SAME

(71) Applicant: PRO-DIP, LLC, Suffern, NY (US)

(72) Inventor: Peter St. Lawrence, Suffern, NY (US)

(73) Assignee: PRO-DIP, LLC, Suffern, NY (US)

( * ) Notice: Subject to any disclaimer, the term of this patent is extended or adjusted under 35 U.S.C. 154(b) by 115 days.

(21) Appl. No.: 15/253,634

(22) Filed: Aug. 31, 2016

(65) Prior Publication Data

US 2018/0057229 A1 Mar. 1, 2018

(51) Int. Cl.

| | |
|---|---|
| ***B65D 65/46*** | (2006.01) |
| ***A24F 23/02*** | (2006.01) |
| ***B65B 1/22*** | (2006.01) |
| ***B65B 1/28*** | (2006.01) |
| ***B65B 9/20*** | (2012.01) |
| ***B65B 9/213*** | (2012.01) |
| ***B65B 29/00*** | (2006.01) |
| ***B65B 51/26*** | (2006.01) |
| ***B65B 51/30*** | (2006.01) |
| ***B65D 75/44*** | (2006.01) |
| ***B65D 85/804*** | (2006.01) |

(52) U.S. Cl.

CPC ..... *B65D 65/463* (2013.01); *A24F 23/02* (2013.01); *B65B 1/22* (2013.01); *B65B 1/28* (2013.01); *B65B 9/2028* (2013.01); *B65B 9/213* (2013.01); *B65B 29/00* (2013.01); *B65B 51/26* (2013.01); *B65B 51/303* (2013.01); *B65D 75/44* (2013.01); *B65D 85/804* (2013.01); *B65B 2220/08* (2013.01)

(58) Field of Classification Search

None

See application file for complete search history.

(56) References Cited

U.S. PATENT DOCUMENTS

| | | | | |
|---|---|---|---|---|
| 5,485,712 | A | 1/1996 | Cherney et al. | |
| 2003/0064092 | A1 | 4/2003 | Hirsh et al. | |
| 2003/0217531 | A1 | 11/2003 | Keen et al. | |
| 2004/0248771 | A1 * | 12/2004 | Raggi | A61P 17/14 514/561 |
| 2007/0134169 | A1 | 6/2007 | Rabinoff | |

(Continued)

FOREIGN PATENT DOCUMENTS

| | | | | |
|---|---|---|---|---|
| CA | 2701869 | A1 * | 5/2009 | A24B 15/183 |
| WO | WO 2010/022360 | | 2/2010 | |

OTHER PUBLICATIONS

21 C.F.R. §177.2800 (Year: 2023).*

(Continued)

*Primary Examiner* — Katherine A Will

(74) *Attorney, Agent, or Firm* — Robert E. Colletti; Haug Partners LLP

(57) ABSTRACT

An oral sachet designed to be placed in a users mouth, the oral sachet. The oral sachet includes permeable paper that does not contain fiberglass. The permeable paper forms a pouch that includes a top seal arranged at first end of the pouch, a bottom seal arranged at a second end of the pouch opposite from the first end, a vertical seal that extends from the top seal to the bottom seal, and a cavity located between the top seal and the bottom seal. Granular contents, including at least one granular or powdered component, are arranged within the cavity of the permeable-paper pouch.

7 Claims, 10 Drawing Sheets

(56) References Cited

U.S. PATENT DOCUMENTS

| | | | | |
|---|---|---|---|---|
| 2008/0202536 | A1* | 8/2008 | Torrence | A24B 13/00 131/275 |
| 2009/0025740 | A1* | 1/2009 | Chappell, Sr. | B65D 75/40 131/352 |
| 2009/0025741 | A1* | 1/2009 | Crawford | A61K 9/009 156/60 |
| 2011/0083402 | A1 | 4/2011 | Walker et al. | |
| 2011/0303232 | A1* | 12/2011 | Williams | B65B 29/00 131/359 |
| 2012/0000161 | A1 | 1/2012 | Free et al. | |
| 2012/0128734 | A1 | 5/2012 | Hübinette et al. | |
| 2012/0298124 | A1 | 11/2012 | Shikata et al. | |
| 2013/0125904 | A1* | 5/2013 | Chen | A24B 15/24 131/275 |
| 2014/0020692 | A1* | 1/2014 | Kawata | A24B 13/00 131/112 |
| 2015/0052857 | A1 | 2/2015 | Hefner et al. | |

OTHER PUBLICATIONS

Mat Villano, *Ex-Ballplayers Offer Coffee's Answer to Chew*, http://www.entrepreneur.com/article/220239 (las visited Nov. 20, 2015).

Sahadev Sharma, *Giving MLB Something New to Chew On*, http://espn.go.com/blog/chicago/cubs/post/_/id/10709/giving-mlb-something-to-new-to-chew-on (last visited on Nov. 20, 2015).

Abigail Tracy, *The Hot New Drug in Major League Baseball? Coffee Grounds*, http://www.vocativ.com/culture/sport/grinds-coffee-pouches/ (last visited on Nov. 20, 2015).

Shark Tank Success, *Get Grinds Coffee Pouch*, http://sharktanksuccess.blogspot.com/2013/02/get-grinds-coffee-pouch.html (last visited on Nov. 20, 2015).

Non-Final Office Action issued on May 10, 2021 in corresponding U.S. Appl. No. 16/379,114.

* cited by examiner

ORAL AND/OR BUCCAL DELIVERY POUCH AND METHOD OF MAKING SAME

FIELD OF THE INVENTION

The concept for the product that is the subject of this application (the "Product") evolved out of observing the use of oral tobacco pouches, particularly by athletes. The idea was that, while the substance contained in these tobacco pouches was harmful, the medium by which the substance was delivered—in other words, the pouch itself—had several advantages. In particular, the pouch is a hands-free delivery system, it requires no water to assist in swallowing (as do pills) and keeping the pouch between the gum and cheek is a pleasurable experience for the user. Thus, the idea was that delivery of a healthy product, which can be dissolved in the mouth via the pouch delivery method, would have all the advantages of the tobacco pouch and none of the disadvantages.

Therefore, the inventors began to experiment with various methods of placing soluble powders into a pouch similar in size and makeup to the tobacco pouches. The size range they found to be an ideal compromise between oral comfort and powder content was a maximum thickness of from 2-8 mm thick, a maximum width of from 10-25 mm wide, and a maximum length of from 35-55 mm long. Preferably the pouch is 4-6 mm thick (max), 15-25 mm wide (max), and 40-50 mm long (max). More preferably, the pouch is 5 mm thick, 22 mm wide, and 47 mm long.

It was discovered that the method used to fill the tobacco pouches with the cut tobacco contents would not work for the Product. That method involves pneumatically forcing the tobacco into the pouches prior to sealing. A similar pneumatic filling method is used to fill tea bags with tea leaves and fines. However, because the contents of the Product are drier, lighter, less dense, and of smaller granularity than tobacco or tea leaves and fines, the force of air from the pneumatic process results in the Product contents being blown through the permeable paper. This leads to the blown-through contents clogging the machine, and prevents an adequate and accurate amount of contents being captured in the pouch.

Eventually, the inventors experimented with commercially accessible vertical fill and seal machines (aka, vertical form, fill, and seal [VFFS] machines), which are the type of machines used to create snack bags (such as those used for potato chips and pretzels) and "stick packs" (such as those used for powders which are poured into water to add flavoring). These VFFS machines use sheets of non-permeable material (e.g., laminate films, polyethylene films, and plastic films) and wrap those materials into a pre-defined shape. A vertical seal is formed to create a cylindrical-type shape, and then a transverse bottom seal is formed to close the bottom in preparation for contents-delivery. Then the machine puts the contents into the opened "bag" through one of a number of methods. The machine then creates another transverse seal for the top, after which the product is fully sealed inside of the container.

Because the method of filling the container with these machines is based on gravity and not pressurized air, the problem of dissipation of the content of the Product was alleviated to an extent, but not fully solved as will be detailed below. In addition, these machines are designed for larger pouches made from non-permeable materials, and the inventors concluded that none of the currently available machines could make the type of pouch size desired using food-grade permeable paper.

The type of machine which came nearest to accomplishing the creation of the Product was the type used to create non-permeable "stick packs" for other types of powders. Initially, the idea at the time was to use the same machine, adjust it for the dimensions of the pouch, and use permeable paper instead of the type of material typically used for stick packs.

However, because the entire Product unit—including the pouch—is intended to be placed into a users mouth (as opposed to stick packs, in which the contents are consumed by tearing open the pouch and removing the contents before throwing the pouch away), the current Product design needed to use FDA-approved, food-grade permeable paper. This design imperative eliminated the use of any available vertical fill and seal machines due to the delicate, low tensile strength of the paper.

Simply explained, previously available fill and seal machines use clamps to pull the bottoms of the package material down as they created each individual bag. Such a "clamp and pull" method works for the non-permeable materials typically used, since they have sufficient tensile strength to withstand such clamping and pulling. Such a clamp-and-pull machine would also likely work with certain tobacco pouch products that use permeable paper, since the permeable paper for tobacco products contains fiberglass and therefore has a higher tensile strength than the food-grade permeable paper of the Product. But since the Product contents are intended to be swallowed and tobacco pouch contents are not, it was not desirable to use paper containing fiberglass for the Product. The paper (as described below) is food-grade, FDA certified paper similar to that used for tea bags. As a result, when such a clamp-and-pull machine was used with the food-grade permeable paper of the Product, the low-tensile-strength paper tore under stress applied by the clamp-and-pull method, and usable pouches of the Product could not be obtained.

In addition, a subsequent problem soon presented itself. Although the gravity-based system used to fill the permeable paper pouches is viable (whereas the pneumatic method is not), the gravity-based method still produces a dissipation of Product contents when the contents hit the bottom-sealed pouch. In other words, the force of the granular and/or powderized contents impacting the bottom of the pouch bag during production creates a dissipation, or "puff", of the contents through the permeable paper. While this does not typically prevent an adequate amount of contents from being captured in the pouch, the airborne dissipated contents interfere with the heat sealing process of the machine. In particular, the contents of the Product include meltable substances that get sticky when heated, such as various sugars and sugar-like substances (e.g., honey; disaccharides like sucrose, maltose, and lactose; monosaccharides like glucose/dextrose, fructose, galactose; sugar alcohols like glycerol [3-carbon], erythritol [4-carbon], threitol [4-carbon], arabitol [5-carbon], xylitol [5-carbon], ribitol [5-carbon], mannitol [6-carbon], sorbitol [6-carbon], galactitol [6-carbon], fucitol [6-carbon], iditol [6-carbon], inositol [6-carbon; a cyclic sugar alcohol], volemitol [7-carbon], isomalt [12-carbon], maltitol [12-carbon], lactitol [12-carbon], maltotriitol [18-carbon], maltotetraitol [24-carbon], and polyglycitol). So if the dissipated contents are not captured at the point of escape from the pouch, then such dissipated contents may settle on the adjacent moving parts of the machine, which will seize or stick causing the machine to shut down. Such dissipated contents may similarly settle on the heat sealing mechanics of the machine, sticking thereto and blocking the equipment from adequately heat-sealing the pouch.

A third issue encountered was the problem of inadequate settling of the contents of the Product. The contents, which are granular, drop into place through a length of paper which is sealed and cut into individual pouches. As it drops, the content sticks to the paper at varying points. The transverse top and bottom seals are heat-based and, when the seals are made on an area of paper that has the granular or powderized content stuck to it, several problems occur. First, the seal is compromised because the content in between the two plies of paper interferes with the seal. Second, the heat-sealing mechanism of the machine becomes compromised because the content adheres to the mechanism and causes it to stick. Third, the Product is compromised because the paper seals are not "clean", and the aesthetics of the Product unit suffers. This "unclean" seal also results in the heat sealing mechanism burning the contents trapped within the seal, thereby producing an "off" taste, and potentially altering the nutrient-profile delivery of any such burned contents to a user.

SUMMARY OF THE INVENTION

As such, it is desirable to provide a new food-grade permeable paper pouch/sachet for oral and/or buccal delivery of granular and/or powderized contents, along with a machine and method for making the same.

According to the present invention there is therefore provided a food-grade permeable paper pouch/sachet for oral and/or buccal delivery of granular and/or powderized contents, along with a machine and method for making the same, as described by way of example below and in the accompanying claims.

In one embodiment of the invention there is provided an oral sachet designed to be placed in a users mouth, the oral sachet. The oral sachet includes permeable paper that does not contain fiberglass. The permeable paper forms a pouch that includes a top seal arranged at first end of the pouch, a bottom seal arranged at a second end of the pouch opposite from the first end, a vertical seal that extends from the top seal to the bottom seal, and a cavity located between the top seal and the bottom seal. Granular contents, including at least one granular or powdered component, are arranged within the cavity of the permeable-paper pouch.

In another embodiment, the vertical seal protrudes from, and does not form part of, an interior surface of the cavity.

In yet another embodiment, the permeable-paper pouch is formed from a single piece of the permeable paper.

In a further embodiment, the oral sachet has a maximum thickness in a range of from 2-10 mm thick, a maximum width in a range of from 8-30 mm wide, and a maximum length in a range of from 8-100 mm long.

In yet a further embodiment, the oral sachet has a maximum thickness in a range of from 2-8 mm thick, a maximum width in a range of from 10-25 mm wide, and a maximum length in a range of from 35-55 mm long.

In another embodiment, the oral sachet has a maximum thickness in a range of 4-6 mm thick, a maximum width in a range of 15-25 mm wide, and a maximum length in a range of 40-50 mm long.

In yet another embodiment, the oral sachet has a maximum thickness of around 5 mm thick, a maximum width of around 22 mm wide, and a maximum length in a range of 44-48 mm long.

In a further embodiment there is provided a vertical form, fill, and seal (VFFS) machine for forming oral sachets and filling oral sachets with granular contents including at least one granular or powdered component. The VFFS machine includes a forming tube, a feed assembly, a vertical sealing device, a guide arrangement, and a transverse sealing device. The feed assembly is configured to feed a continuous sheet of non-fiberglass-containing permeable paper to the forming tube and to wrap the non-fiberglass-containing permeable paper around the forming tube. The permeable paper has an inside surface that faces toward the forming tube when the permeable paper is wrapped around the forming tube, an outside surface that faces away from the forming tube when the permeable paper is wrapped around the forming tube, a first edge surface that is arranged between the inside surface and the outside surface, and a second edge surface, opposite to the first edge surface, that is arranged between the inside surface and the outside surface. The vertical sealing device is disposed adjacent the forming tube, and is configured to form a sleeve from the permeable paper by sealing a first portion of the inside surface to a second portion of the inside surface to create a vertical seal, the first portion of the inside surface being adjacent to the first edge and the second portion of the inside surface being adjacent to the second edge. The guide arrangement is located downstream of the first sealing device and adjacent to the forming tube, and is configured to grip the vertical seal and pull the vertical seal in a downstream direction. The transverse sealing device is located downstream of the guide arrangement, and is configured to seal a third portion of the inside surface to a fourth portion and a fifth portion of the inside surface to create a bottom transverse seal that intersects the vertical seal, thereby forming a closed bottom end for a current sachet to be formed, each of the fourth and fifth portions being opposite to the third portion, with the fourth portion being adjacent to one side of the vertical seal and the fifth portion being adjacent to an opposite side of the vertical seal.

In yet a further embodiment, the guide arrangement includes two rollers that abut each other and grip the vertical seal therebetween, the two rollers rotating in opposite directions to pull the vertical seal in the downstream direction.

In another embodiment, the vertical sealing device is a heat sealer.

In yet another embodiment, the transverse sealing device is a heat sealer.

In a further embodiment, the VFFS machine further includes a suction device configured to capture airborne granular content that escapes from the permeable paper sleeve, when the sleeve is filled with granular content, by suctioning the escaped airborne granular content.

In yet a further embodiment, the VFFS machine further includes a settling device configured to physically impact or vibrate the VFFS machine while the permeable paper sleeve is being filled with granular contents so as to settle the granular contents being filled into a bottom of the current sachet to be formed.

In another embodiment, the transverse sealing device is also configured to, after creating the bottom transverse seal, seal a sixth portion of the inside surface to a seventh portion and an eighth portion of the inside surface to create a top transverse seal that intersects the vertical seal, thereby forming a closed top end for the current sachet to be formed, each of the seventh and eight portions being opposite to the sixth portion, with the seventh portion being adjacent to the one side of the vertical seal and the eight portion being adjacent to the opposite side of the vertical seal.

In yet another embodiment, the transverse sealing device is also configured to form a bottom transverse seal for a next sachet to be formed simultaneously with the top transverse seal for the current sachet to be formed.

In a further embodiment, the transverse sealing device includes a cutting device configured to cut the permeable paper at a location between the top transverse seal for the current sachet to be formed and the bottom transverse seal for the next sachet to be formed, thereby separating the current sachet to be formed from the next sachet to be formed.

In yet a further embodiment a method is provided for forming oral sachets and filling oral sachets with granular contents including at least one granular or powdered component. The method includes feeding a continuous sheet of non-fiberglass-containing permeable paper to a forming tube and wrapping the non-fiberglass-containing permeable paper around the forming tube. The permeable paper has an inside surface that faces toward the forming tube when the permeable paper is wrapped around the forming tube, an outside surface that faces away from the forming tube when the permeable paper is wrapped around the forming tube, a first edge surface that is arranged between the inside surface and the outside surface, and a second edge surface, opposite to the first edge surface, that is arranged between the inside surface and the outside surface. Next, a sleeve is formed from the permeable paper by sealing a first portion of the inside surface to a second portion of the inside surface to create a vertical seal, the first portion of the inside surface being adjacent to the first edge and the second portion of the inside surface being adjacent to the second edge. Then the vertical seal is gripped and pulled in a downstream direction. After this step, a third portion of the inside surface is sealed to a fourth portion and a fifth portion of the inside surface to create a bottom transverse seal that intersects the vertical seal, thereby forming a closed bottom end for a current sachet to be formed. Each of the fourth and fifth portions are opposite to the third portion, with the fourth portion being adjacent to one side of the vertical seal and the fifth portion being adjacent to an opposite side of the vertical seal.

In another embodiment, the gripping and pulling of the vertical seal includes gripping the vertical seal between two abutting rollers, and rotating the two rollers in opposite directions to pull the vertical seal in the downstream direction.

In yet another embodiment, the vertical seal is formed by heat sealing the first portion of the inside surface to the second portion of the inside surface.

In a further embodiment, the transverse seal is formed by heat sealing the third portion of the inside surface to the fourth portion and the fifth portion of the inside surface.

In yet a further embodiment, the method includes capturing airborne granular content that escapes from the permeable paper sleeve, when the sleeve is filled with granular content, by suctioning the escaped airborne granular content.

In another embodiment, the method includes physically shaking or vibrating the permeable paper sleeve while it is being filled with granular contents so as to settle the granular contents being filled into a bottom of the current sachet to be formed.

In yet another embodiment, after creating the bottom transverse seal, a sixth portion of the inside surface is sealed to a seventh portion and an eighth portion of the inside surface to create a top transverse seal that intersects the vertical seal, thereby forming a closed top end for the current sachet to be formed. Each of the seventh and eight portions are opposite to the sixth portion, with the seventh portion being adjacent to the one side of the vertical seal and the eight portion being adjacent to the opposite side of the vertical seal.

In a further embodiment, the method also includes forming a bottom transverse seal for a next sachet to be formed simultaneously with forming the top transverse seal for the current sachet to be formed.

In yet a further embodiment, the method also includes cutting the permeable paper at a location between the top transverse seal for the current sachet to be formed and the bottom transverse seal for the next sachet to be formed, thereby separating the current sachet to be formed from the next sachet to be formed.

It is noted that the features of the above-described embodiments are not exclusive to each other, and that any one of the above embodiments/features can be combined with one or more of the other embodiments/features to arrive at further embodiments.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments. It is noted that any numerical ranges disclosed herein are included to individually disclose every sub-range and number, both whole integer and partial fraction, within the disclosed range. For example, a disclosed range of 1-100 is intended to individually disclose 20-90, 40-80, 30.5-50.2, 20, 67.3, 84.512924, and every other range and number that falls within the recited range.

Figure 1:
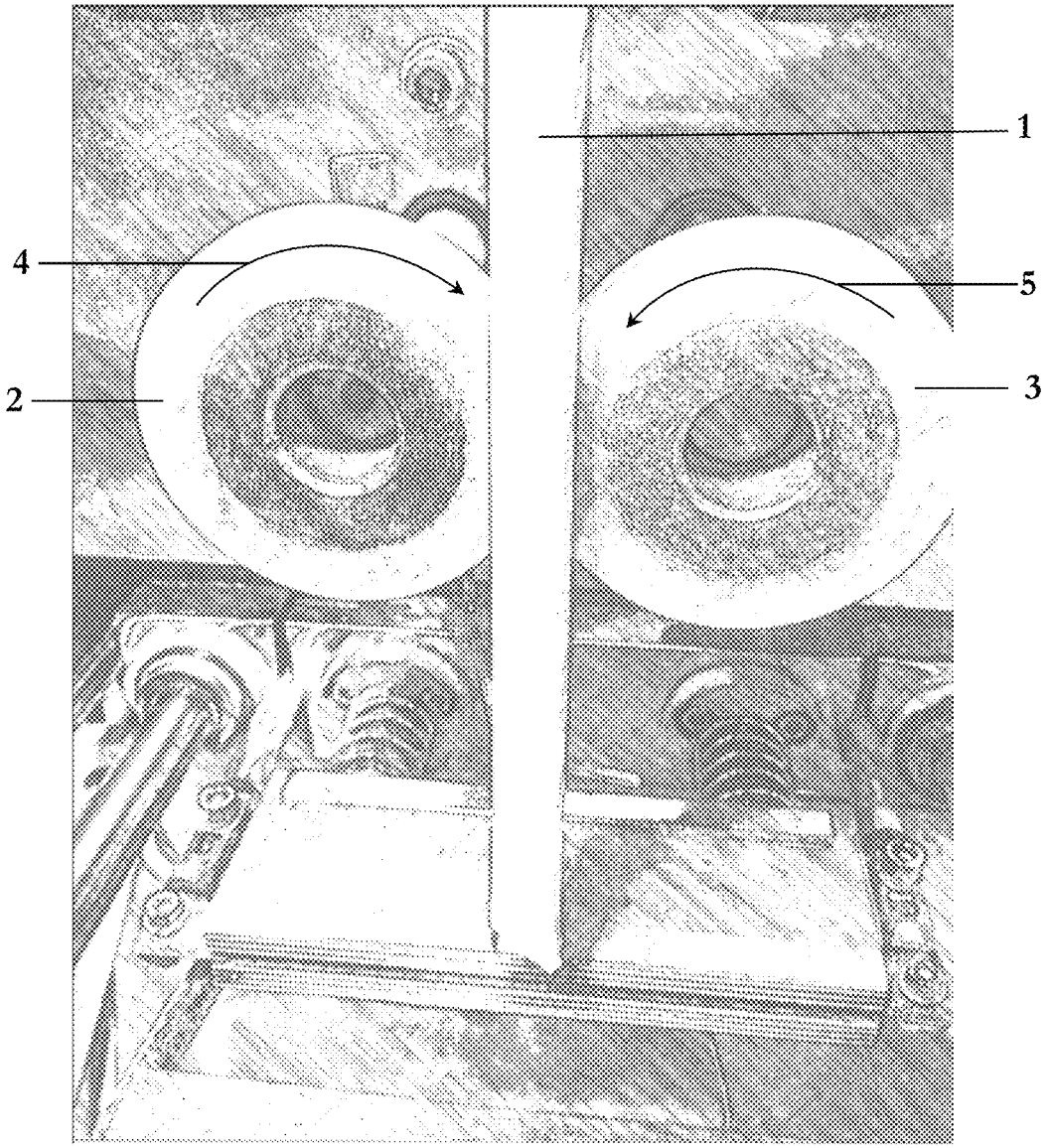
FIG. 1 shows a twin-wheel pull system according to an embodiment of the invention.
Figure 2:
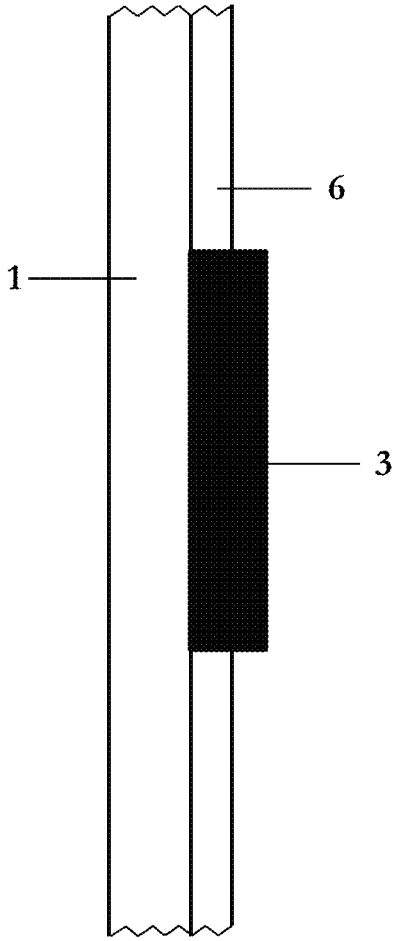
FIG. 2 shows a simplified side view of the twin-wheel pull system according to an embodiment of the invention.
Figure 3:
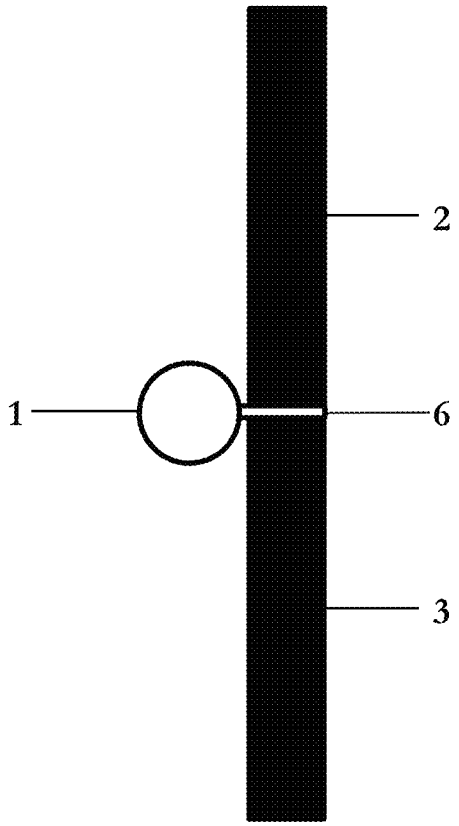
FIG. 3 shows a simplified top view of the twin-wheel pull system according to an embodiment of the invention.

The above issue of transporting the food-grade permeable paper tube or sleeve 1 without tearing it was resolved by a major innovation to the standard fill and seal machines. As shown in FIGS. 1-3, the inventors replaced the "clamp and pull" mechanism with a pair of dual abutting wheels 2, 3, which, by rotating in opposite directions 4, 5, draws the more delicate paper 1 down on a "fin seal" (i.e., vertical seal) side 6 of the paper tube 1 without tearing it. FIG. 1 shows a front view, while FIGS. 2 and 3 show simplified side and top views respectively.

Thus the first machine used to successfully generate the Product was a vertical fill and seal machine which had been customized to utilize the twin-wheel pulling device and method (a more detailed description of the machine is provided below).

Figure 4:
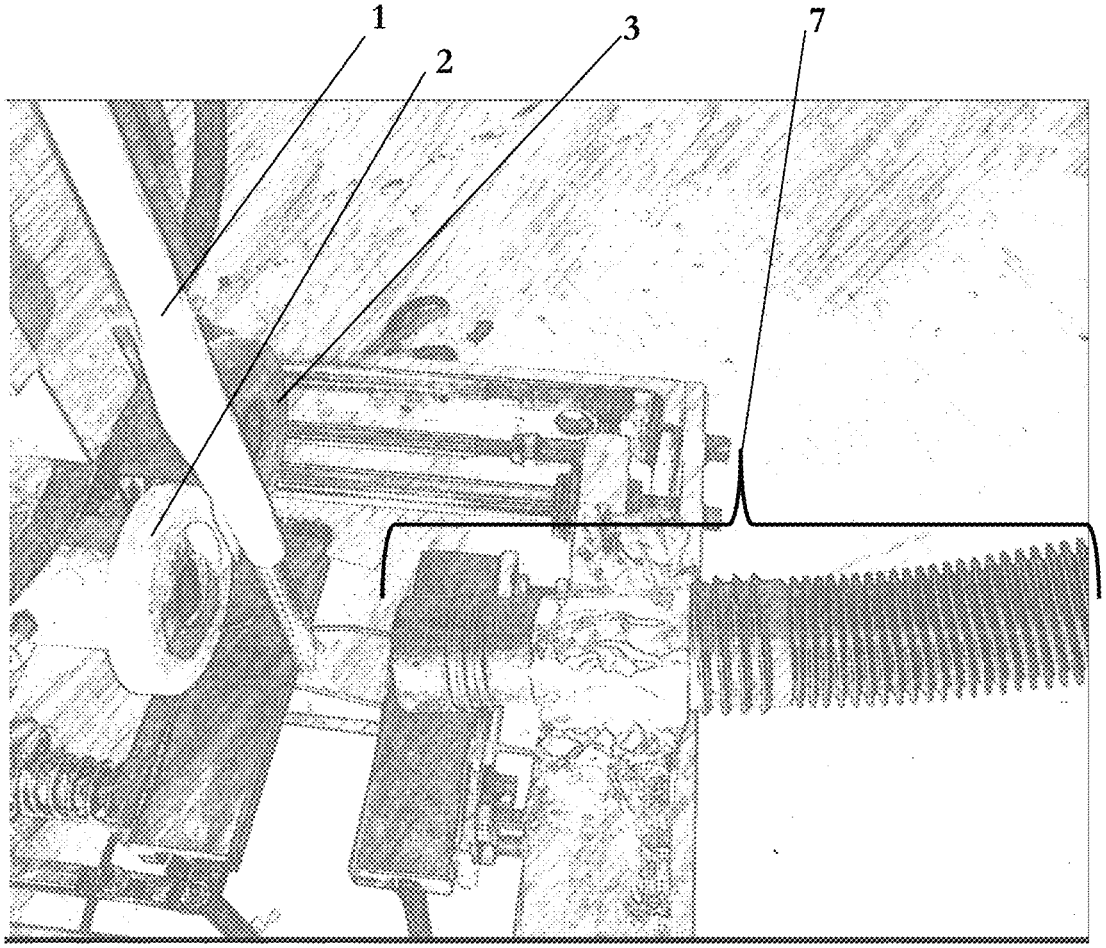
FIG. 4 shows a form and fill machine that includes a suction device, according to an embodiment of the invention.

The above second issue of airborne dissipation of contents upon filling was solved by a second innovative modification of the form and fill machine, shown in FIG. 4—namely, the use of a suction device 7, such as a vacuum, to capture airborne content that escapes the pouches during the manufacturing process. By suctioning the material as soon as it becomes airborne, the aforementioned problem is successfully addressed and without the suctioning, the mass production would not be possible.

Figure 5:
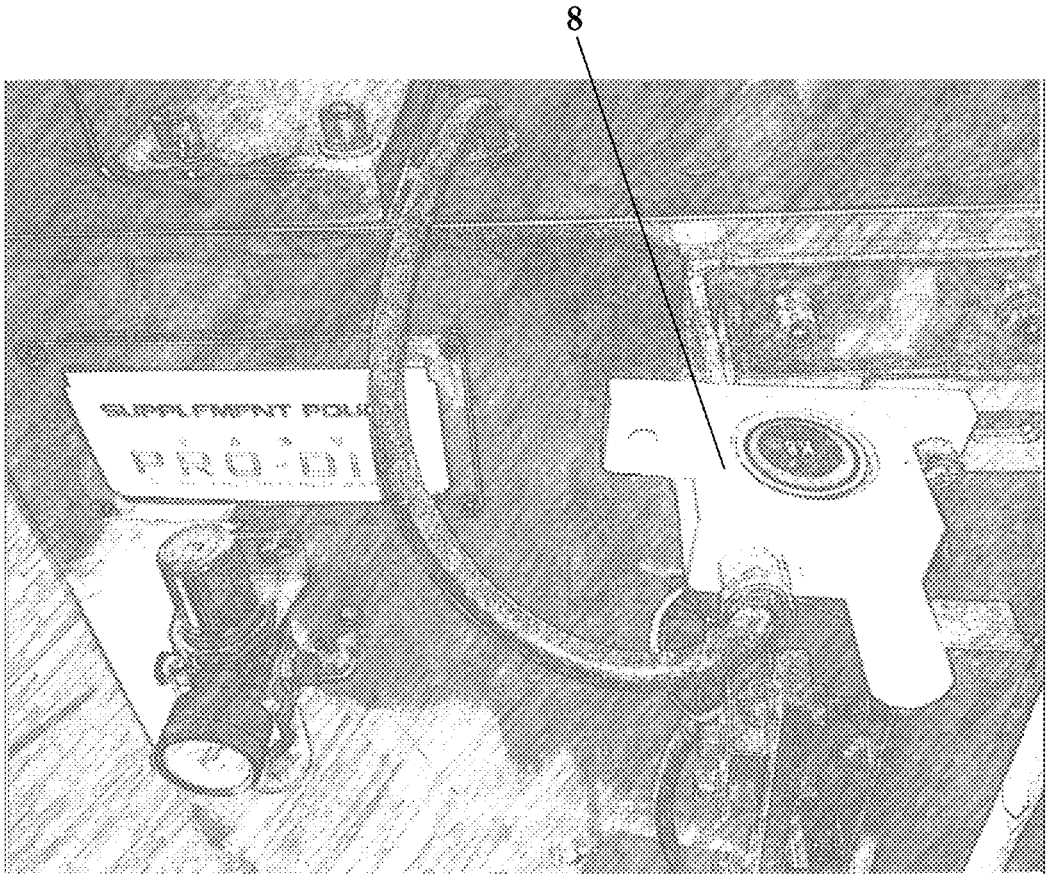
FIG. 5 shows a form and fill machine that includes a vibration or impact-based settling device, according to an embodiment of the invention.

The above third issue of inadequate settling was solved by the inventors by implementing a vibration or impact-based settling device and method, as shown in FIG. 5, to ensure proper settling of contents inside the pouch/tube. Essentially, this settling system/device 8 entails applying a physical impact or vibration to the main filling machine immediately after contents fall into the packet/tube, but before the transverse top seal is complete. The applied physical impact settles the content into the bottom of the unsealed pouch and avoids the problem described above. Applying vibration, preferably constant, to the machine while filling the sachets also aids in settling. Examples of such a settling device include vibrating motors (such as electric vibrators, hydraulic vibrators, or pneumatic vibrators, each of which may be either an eccentric rotating mass vibration motor [ERM] or a linear actuator like a linear resonant actuator LRA]), sanders (such as sufficiently large hand sanders), and air pumps (such as tire pumps). Preferably the settling device is a vibrating or low impact mechanism in the position indicated in FIG. 5.

Figure 6:
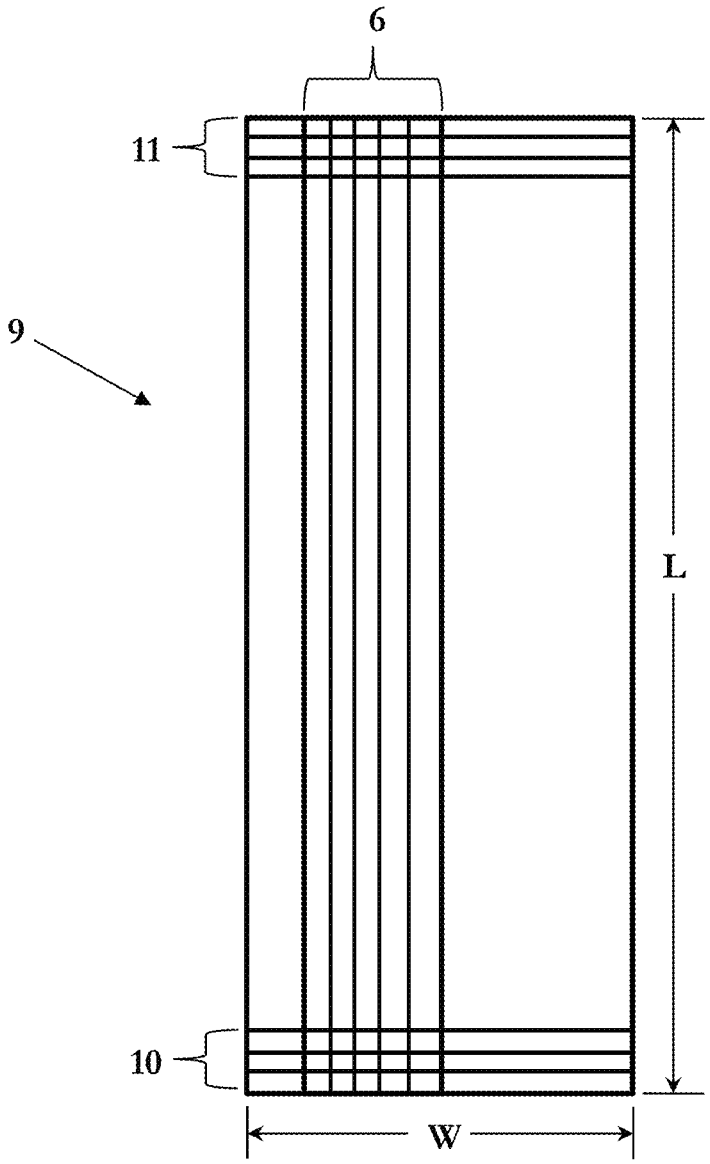
FIG. 6 shows an oral and/or buccal delivery pouch/sachet according to an embodiment of the invention.

The inventive oral and/or buccal delivery pouch 9 (i.e., "the Product") is shown in FIG. 6, and is comprised of granular and/or powderized content contained within permeable paper and sealed into pouches. As shown in FIG. 6, each pouch 9 has a "fin seal" (i.e., vertical seal) 6, a bottom seal 10, and a top seal 11. The individual pouches size is 8 mm to 30 mm in width W, 8 mm to 100 mm in length L, and 2 mm to 10 mm in depth. As explained above, the size range they found to be an ideal compromise between oral comfort and powder content was a maximum thickness of from 2-8 mm thick, a maximum width of from 10-25 mm wide, and a maximum length of from 35-55 mm long. Preferably the pouch is 4-6 mm thick (max), 15-25 mm wide (max), and 40-50 mm long (max). More preferably, the pouch is 5 mm thick, 22 mm wide, and 47 mm long. Each pouch contains between 0.5 g and 15 g of granular and/or powderized content. Preferably, each pouch contains between 1.0 g and 4.0 g of granular and/or powderized content. More preferably, the pouch contains between 1.0 g and 3.0 g of granular and/or powderized content. Most preferably, pouch contains around 2.0 g of granular and/or powderized content.

The manufacturing method is described as follows and takes place within the modified vertical fill and seal machines described above. The first step of the process is that the granular content is loaded into a holder or hopper at the top of the machine. The granular content is then fed into a cylindrical forming tube which is between 22 cm and 28 cm in length by one of two methods—an auger method and a plate method.

In the auger method, the granular content is loaded into the forming tube by turning an auger located at the bottom of the hopper and encased in a metal tube. The auger rotates at a rate between 0.1 rpm and 0.9 rpm.

In the plate method, the granular content is fed onto a plate above cups which vary in capacity from 0.25 g to 6 g. An arm then sweeps across the top of the holding plate, leveling the content after which the cups below the plate open, releasing the granular content into the forming tube.

Figure 7:
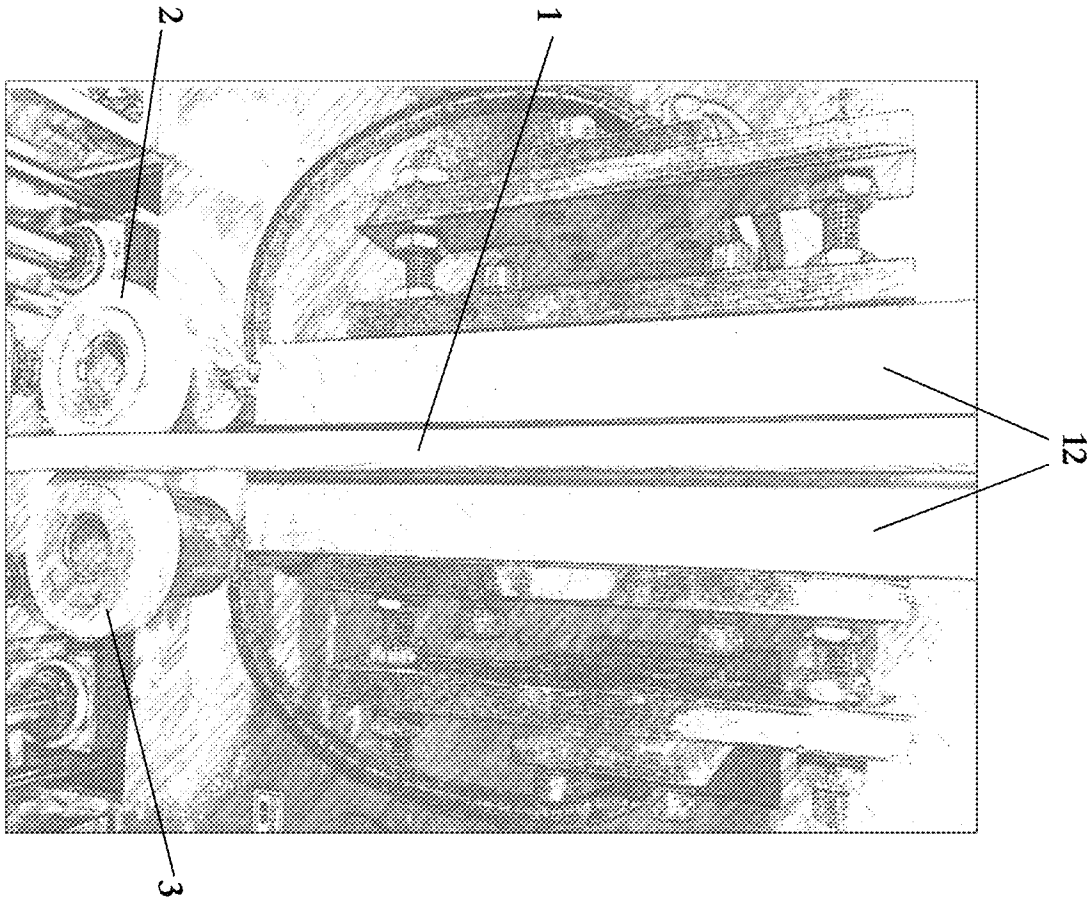
FIG. 7 shows a heat sealer applying a vertical heat seal to the edges of permeable paper as it passes around a forming tube, according to an embodiment of the invention.

The permeable paper is drawn down around the forming tube, which forms the permeable paper into a cylindrical shape. As shown in FIG. 7, a sealing device 12 (such as a heat sealer) applies the vertical "fin" heat seal 6 to the edges of the permeable paper 1 as it passes around the forming tube. It is this vertical seal 6 that is then pulled by the two wheels 2, 3 to transport the paper/tube 1 in the downstream direction. In addition, a transverse seal (the "bottom seal") is made on the permeable paper. The vertical seal and the bottom transverse seal create a paper tube with an open top. The granular content is dropped into the top of this open tube using the auger or plate method (or a combination) described above. At this point the impact/vibration method described above is applied to ensure proper settling of the Granular Content at the bottom of the tube/pouch and the suction method described above is applied to limit the airborne dissipation of the granular content. The paper is then drawn down by a length of 8 cm to 100 cm centimeters (depending on the predetermined length of the final sachet) using the two wheels 2, 3 as described above, and an additional transverse heat seal (the "top seal") is applied to create a fully sealed pouch.

Figure 8:
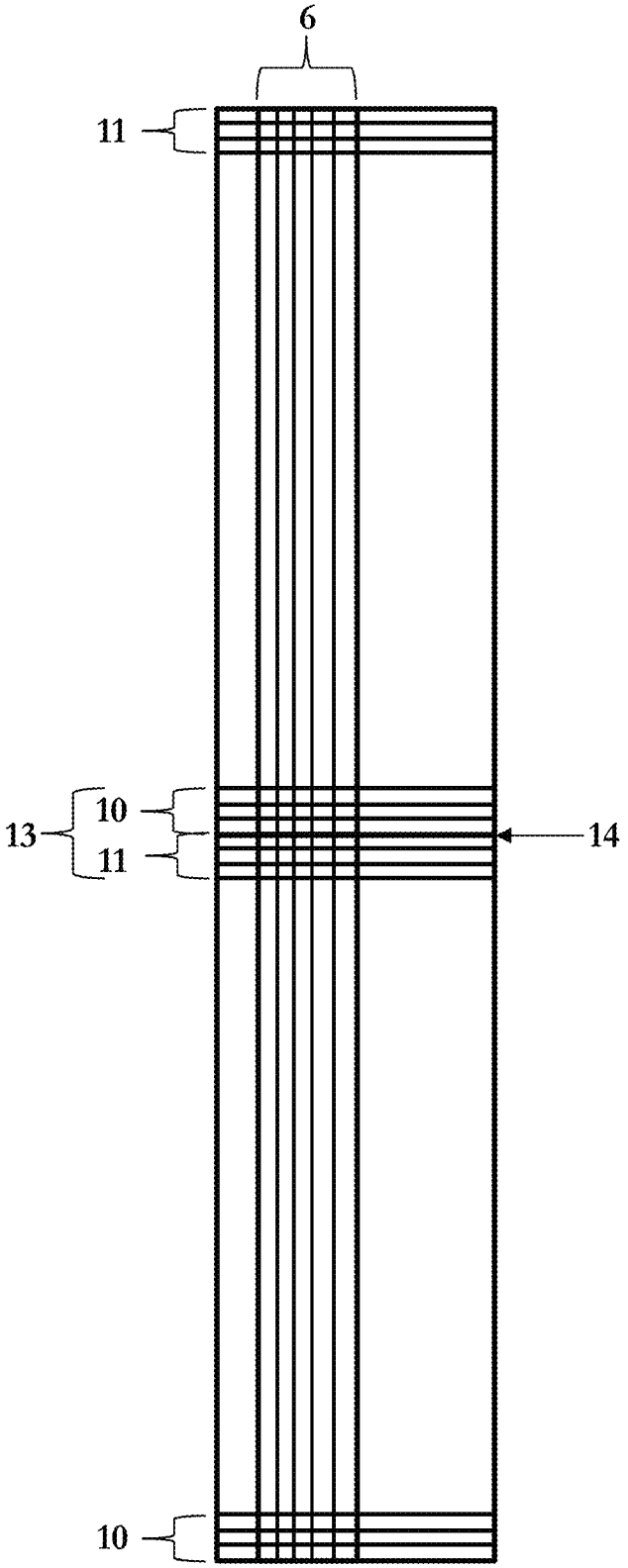
FIG. 8 shows how a single transverse seal forms the top transverse seal of one pouch and the bottom transverse seal of an adjacent pouch, according to an embodiment of the invention.

In an embodiment shown in FIG. 8, a single transverse seal 13 forms both the top transverse seal 11 of a currently filled pouch as well as the bottom transverse seal 10 for the next pouch to be filled. The fully sealed pouches are then cut at region 14 to separate the pouches from each other.

Figure 9:
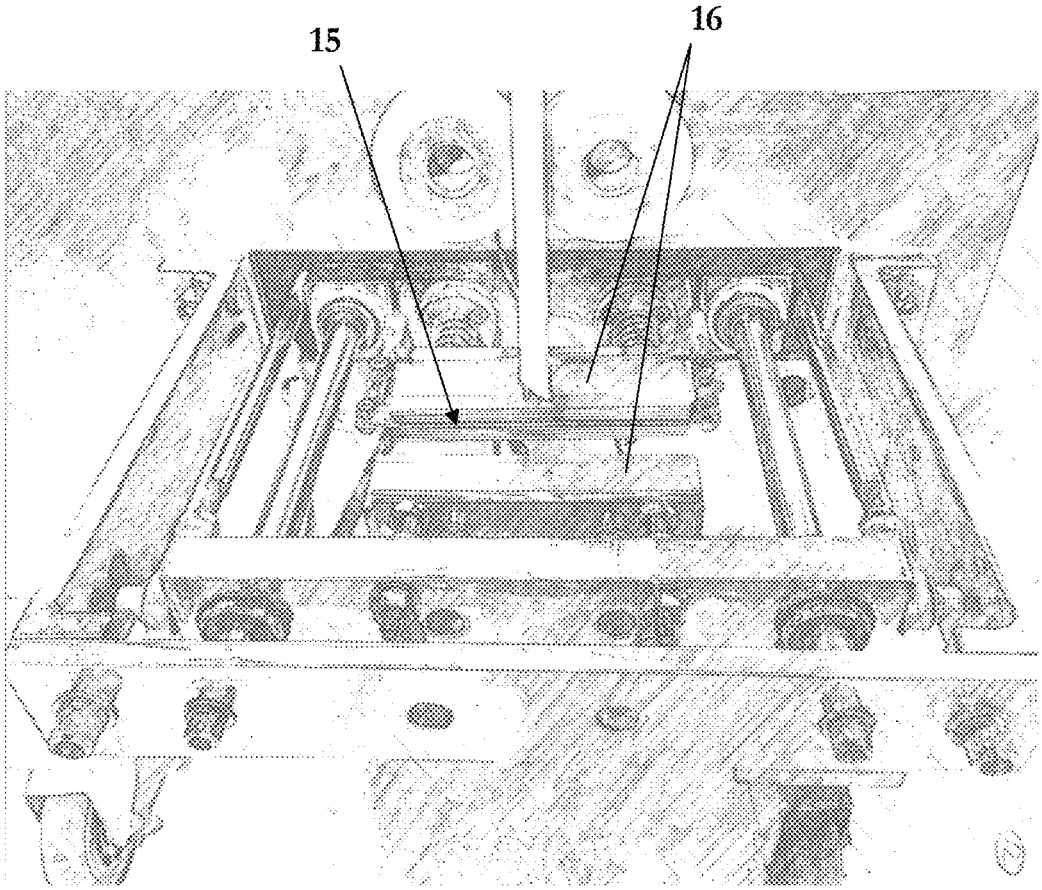
FIG. 9 shows a transverse heat sealer with a metal blade enclosed therein for simultaneously sealing the sachets and separating them from each other, according to an embodiment of the invention.

In an embodiment shown in FIG. 9, a metal blade 15 may be enclosed in on side, or both sides, of the transverse sealing device 16 (such as a heat sealer). In this way, the forming of the transverse seal 13 and the cutting of that seal 13 to separate the top transverse seal 11 of a currently filled pouch from the bottom transverse seal 10 of a pouch to be filled, can be performed simultaneously in a single step. For such a simultaneous sealing and cutting, the actual timing of the cutting may occur slightly before the seal is made if the cutting blade (or blades) 15 sticks out closer to the paper than the heat-sealing surface of the transverse heat sealer 16 (such as depicted in FIG. 9). On the other hand, the actual timing of the cutting may occur while the seal is being made, or slightly after the seal is made, if the cutting edge of the blade (or blades) 15 is slightly recessed from the heat-sealing surface of the transverse heat sealer 16, so that the heat-sealing surface of the transverse heat sealer 16 contacts the paper tube 1 before the blade 15. In the event that the cutting edge of the blade 15 is slightly recessed from the heat-sealing surface of the transverse heat sealer 16, the heat-sealing-and-cutting unit is configured so that the cutting edge of the blade 15 moves with respect to the heat-sealing surface of the transverse heat sealer 16 after the two the heat-sealing surfaces of the transverse heat sealer 16 compress the paper tube 1 to begin sealing the tube 1.

Figure 10:
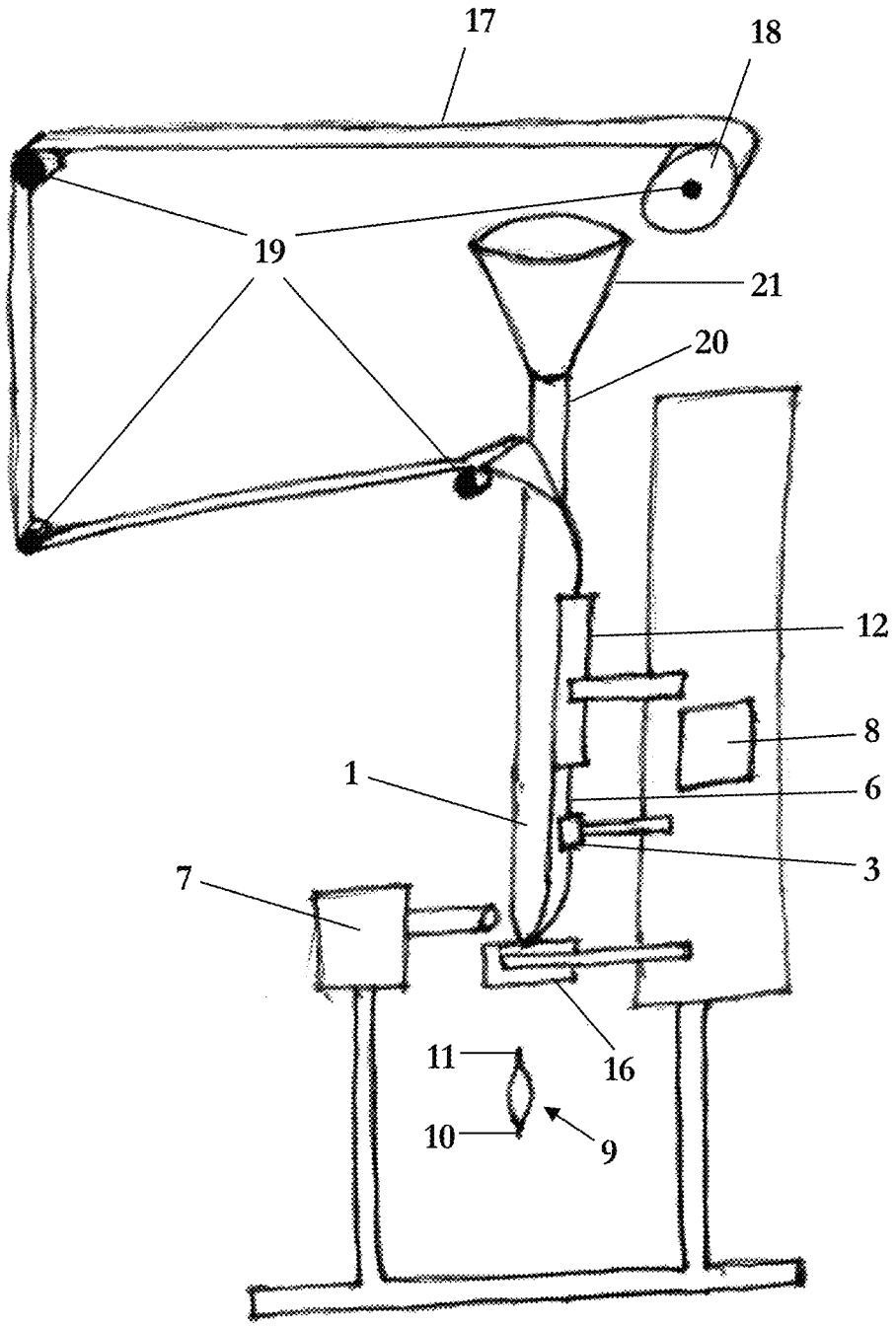
FIG. 10 shows a simplified profile-perspective view of a VFFS machine according to an embodiment of the invention.

FIG. 10 shows a simplified profile-perspective view of a VFFS machine according to an embodiment of the invention. As discussed above, the VFFS machine transports a continuous sheet of non-fiberglass-containing permeable paper 17 from a spool 18 via a feed assembly comprising various rollers and wheels 19, each of which may or may not be mechanized. The permeable paper 17 is wrapped around a forming tube 20, which is in communication with and/or connected to a hopper 21 that contains the granular content. The vertical seal (i.e., "fin seal") 6 is then formed by the vertical sealing device 12 (e.g., a heat sealer) to form the permeable paper sleeve 1. The dual abutting wheels 2, 3 grip the vertical seal 6, and rotate in opposite directions to pull the permeable paper sleeve 1 in the downstream direction toward the transverse sealing device 16 (e.g., a heat sealer).

The transverse sealing device 16 then forms the bottom transverse seal 10, after which the granular product is fed into the sleeve 1 from the hopper 21 while the settling device 8 impacts and/or vibrates the VFFS machine to settle the granular product at the bottom of the sleeve 1 adjacent to the bottom transverse seal 10, and while the suction device 7 (e.g., a vacuum) sucks up any airborne granular product that may escape from the permeable paper tube 1.

Once the permeable paper tube 1 is filled with the predetermined amount of granular product, the tube 1 is again transported in the downstream direction by a predetermined amount so that the portion of the permeable paper tube 1 that contains the granular product is arranged below the transverse sealing device 16. The transverse sealing device 16 then forms the top transverse seal 11 (on the upstream side of the granular product in the tube 1) for the current oral sachet 9 simultaneously with the bottom transverse seal 10 for the next oral sachet to be formed, and the current oral sachet 9 is separated from the rest of the paper tube 1.

The permeable paper is heat-sealable, food-grade permeable paper of tea-paper porousness, with a very low tensile strength. The paper is configured so that it can be heat sealed at a temperature in the range of 117-145 degrees Fahrenheit.

The granular content may include any water-soluble granular or powderized substance which can be absorbed through the permeable paper and is fit for human consumption. The granular content can may also include content that is safe for human consumption but which will not dissolve or absorb through the permeable paper. The granular content should not include any substance that is not safe for human consumption. Examples of suitable granular-content components include honey, dietary fiber, vitamins (such as vitamin A, vitamin B1, vitamin B2, vitamin B5 [pantothenic acid], vitamin B7 [biotin], vitamin B12, vitamin C, vitamin D, vitamin E, and vitamin K2), guar gum, xantham gum, silica, silica dioxide, citric acid, malic acid, potassium citrate, sodium citrate, soluble corn fiber, maltodextrin, tricalcium phosphate, fruit and vegetable extracts (such as grape skin extract, acai fruit extract, green tea leaf extract, raspberry extract lyceum [goji] berry extract, bilberry fruit extract, blueberry fruit extract, elderberry fruit extract, pomegranate fruit extract, cherry extract, blackberry extract, and cranberry extract), acesulfame potassium, sucralose, carmine, soy lecithin, food-grade natural and artificial flavorings and flavonoids (such as anthocyanins), food-grade proteins (such as whey protein and peptides, egg protein, rice protein, soy protein, casein), amino acids (such as phenylalanine, valine, threonine, tryptophan, methionine, leucine and leucine peptides, isoleucine, lysine, histidine, alanine and beta-alanine, aspartic acid, asparagine, glutamic acid, serine, arginine and L-arginine, cysteine, glycine, glutamine, proline, tyrosine, cystine, taurine, citrulline and citrulline malate, and 5-hydroxytryptophan [5-HTP]), amino acid derivatives (such as carnitine and carnitine-tartrate, betaine and anhydrous betaines [e.g., trimethylglycine and anhydrous trimethylglycine], and dimethylglycine [DMG]), gamma-aminobutyric acid (GABA), ZMA (zinc monomethionine aspartate, magnesium aspartate, and vitamin B6; or magnesium aspartate, zinc I-methionine, zinc aspartate, and pyridoxine hydrochloride), creatine, glucuronolactone, caffeine, minerals (such as sodium, calcium, phosphorous, iodine, magnesium, zinc, selenium, copper, manganese, chromium, molybdenum, potassium, and boron), hormones (such as melatonin), griffonia simplicifolia and griffonia simplicifolia seed, and any of the previously listed sugars and sugar-like substances.

In one embodiment, the granular content only includes water-soluble granular or powderized substance which can be absorbed through the permeable paper and is fit for human consumption, and does not include which will not dissolve or absorb through the permeable paper (such as coffee beans and coffee bean particles, tea leaves and tea leaf particles, tobacco leaves and tobacco leaf particles, or similar non-water-soluble content).

The particle size of the granular content can be controlled to have a maximum particle size of 6730 microns or less. The particle size of the granular content can be controlled to have a maximum particle size in a range of from 37 microns to 6730 microns. Such maximum particle sizes can be obtained by sifting/filtering the various components of the granular content through sieves. Examples of various mesh sizes that can be used to control the particle size of the granular product are set forth below:

TABLE 1

Sieve Mesh Size to Micron Conversion Chart

| U.S. Mesh | Inches | Microns | Millimeters |
|---|---|---|---|
| 3 | 0.2650 | 6730 | 6.730 |
| 4 | 0.1870 | 4760 | 4.760 |
| 5 | 0.1570 | 4000 | 4.000 |
| 6 | 0.1320 | 3360 | 3.360 |
| 7 | 0.1110 | 2830 | 2.830 |
| 8 | 0.0937 | 2380 | 2.380 |
| 10 | 0.0787 | 2000 | 2.000 |
| 12 | 0.0661 | 1680 | 1.680 |
| 14 | 0.0555 | 1410 | 1.410 |
| 16 | 0.0469 | 1190 | 1.190 |
| 18 | 0.0394 | 1000 | 1.000 |
| 20 | 0.0331 | 841 | 0.841 |
| 25 | 0.0280 | 707 | 0.707 |
| 30 | 0.0232 | 595 | 0.595 |
| 35 | 0.0197 | 500 | 0.500 |
| 40 | 0.0165 | 400 | 0.400 |
| 45 | 0.0138 | 354 | 0.354 |
| 50 | 0.0117 | 297 | 0.297 |
| 60 | 0.0098 | 250 | 0.250 |
| 70 | 0.0083 | 210 | 0.210 |
| 80 | 0.0070 | 177 | 0.177 |
| 100 | 0.0059 | 149 | 0.149 |
| 120 | 0.0049 | 125 | 0.125 |
| 140 | 0.0041 | 105 | 0.105 |
| 170 | 0.0035 | 88 | 0.088 |
| 200 | 0.0029 | 74 | 0.074 |
| 230 | 0.0024 | 63 | 0.063 |
| 270 | 0.0021 | 53 | 0.053 |

TABLE 1-continued

| Sieve Mesh Size to Micron Conversion Chart | | | |
|---|---|---|---|
| U.S. Mesh | Inches | Microns | Millimeters |
| 325 | 0.0017 | 44 | 0.044 |
| 400 | 0.0015 | 37 | 0.037 |

It is noted that the sieve sizes above are only examples, and the current Product envisions potentially using any sieve size, or combination of sizes, in the range of 3 mesh to 400 mesh.

In addition to controlling the maximum particle size of the granular product, the minimum particle size can also be controlled using various sieve sizes. This is beneficial because it has been discovered that if the particle size of the granular product is too large, greater than 595 microns (30 mesh), then the product has poor dissolution and absorption properties when the pouch/sachet 9 is placed in the mouth between the lip and gums. On the other hand, it has been discovered that if the particle size of the granular product is too small, smaller than 117 microns (80 mesh), then the granular product has difficulty falling into the tube 1 when being filled to create a sachet 9, and the granular product tends to clog upstream of the bottom seal 10 of the tube 1 (i.e., the third issue of inadequate settling of the contents of the Product is exacerbated). In addition, a particle size that is too small can result in increased puffing/billowing in the event the granular product does make it all the way down to the bottom seal 10. This creates additional problems with ensuring that a sufficient amount of the granular contents that dissipate through the permeable paper are captured by the suction device 7 before they can settle on various parts of the machinery (e.g., the heat sealers, gears, cutter, etc.). In this way, the particle size of the granular product can be controlled so as to be fine enough to break down and dissolve in the presence of saliva, but not so fine that it sticks together and fails to adequately flow through the machine.

To ensure the particle size of the granular content is in the appropriate range, the components of the granular content can be first screened by a 30 mesh sieve to ensure a maximum particle size of 595 microns. The first screened components can then be subjected to a further second screening by an 80 mesh sieve to eliminate the particles smaller than 177 microns. This would ensure that all the particles of the various components of the granular product have a particle size in the range of from 177 microns (i.e., minimum particle size) to 595 microns (i.e., maximum particle size). Preferably all the particles of the various components of the granular product have a particle size in the range of from 210 microns (70 mesh) to 500 microns (35 mesh), more preferably in the range of from 250 microns (60 mesh) to 400 microns (40 mesh).

It is noted that the terminology used above is for the purpose of reference only, and is not intended to be limiting. For example, terms such as "upper", "lower", "above", "below", "rightward", "leftward", "clockwise", and "counterclockwise" refer to directions in the drawings to which reference is made. As another example, terms such as "inward" and "outward" may refer to directions toward and away from, respectively, the geometric center of the component described. As a further example, terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

In addition, it is noted that citation or identification of any document in this application is not an admission that such document is available as prior art to the present invention.

The invention claimed is:

1. An oral sachet designed to be placed in a user's mouth, the oral sachet comprising:

a food-grade permeable paper that does not contain fiberglass, the food-grade permeable paper forming a pouch that consists of:

a top seal arranged at first end of the pouch;

a bottom seal arranged at a second end of the pouch opposite from the first end;

a vertical seal that extends from the top seal to the bottom seal; and a cavity located between the top seal and the bottom seal;

wherein the top seal and the bottom seal do not have any granular or powered component trapped therein;

granular contents comprising granular or powdered components having a particle size in the range of 177 microns to 595 microns, wherein the granular contents are dissolvable through the food-grade permeable paper, and wherein the granular or powdered component consists essentially of vitamins, sodium, caffeine, beta-alanine, betaine, and taurine.

2. The oral sachet according to claim 1;

wherein the oral sachet has:

a maximum thickness in a range of from 2-10 mm thick;

a maximum width in a range of from 8-30 mm wide; and a maximum length in a range of from 8-100 mm long.

3. The oral sachet according to claim 2;

wherein the oral sachet has:

a maximum thickness in a range of from 2-8 mm thick;

a maximum width in a range of from 10-25 mm wide; and a maximum length in a range of from 35-55 mm long.

4. The oral sachet according to claim 3;

wherein the oral sachet has:

a maximum thickness in a range of 4-6 mm thick;

a maximum width in a range of 15-25 mm wide; and a maximum length in a range of 40-50 mm long.

5. The oral sachet according to claim 4;

wherein the oral sachet has:

a maximum thickness of around 5 mm thick;

a maximum width of around 22 mm wide; and a maximum length in a range of 44-48 mm long.

6. The oral sachet according to claim 1;

wherein the granular contents have a particle size between around 210 microns and 500 microns.

7. The oral sachet according to claim 1;
wherein the granular contents have a particle size between around 250 microns and 400 microns.

* * * * *